US011344122B2

(12) United States Patent
Serena

(10) Patent No.: US 11,344,122 B2
(45) Date of Patent: May 31, 2022

(54) CHAIR ADAPTED TO FORCE A FORWARD AND DOWNWARD MOVEMENT OF THE SEAT WITH RESPECT TO A BACKWARD INCLINATION IMPARTED TO THE BACKREST

(71) Applicant: BRADO S.P.A., Frazione Bigolino (IT)

(72) Inventor: Stefano Serena, Caerano di San Marco (IT)

(73) Assignee: BRADO S.P.A., Valdobbiadene (IT)

( * ) Notice: Subject to any disclaimer, the term of this patent is extended or adjusted under 35 U.S.C. 154(b) by 240 days.

(21) Appl. No.: 16/791,304

(22) Filed: Feb. 14, 2020

(65) Prior Publication Data

US 2020/0268154 A1 Aug. 27, 2020

(30) Foreign Application Priority Data

Feb. 26, 2019 (IT) ..... 102019000002723

(51) Int. Cl.
*A47C 1/032* (2006.01)
*A47C 3/026* (2006.01)
*A47C 7/28* (2006.01)

(52) U.S. Cl.
CPC ..... *A47C 1/03255* (2013.01); *A47C 7/285* (2013.01)

(58) Field of Classification Search
CPC . A47C 1/03255; A47C 7/285; A47C 1/03277; A47C 3/026; A47C 3/02
USPC ..... 297/300.2
See application file for complete search history.

(56) References Cited

U.S. PATENT DOCUMENTS

| | | | | |
|---|---|---|---|---|
| 2,471,024 | A | 5/1949 | Cramer | |
| 5,423,594 | A * | 6/1995 | Hancock | A47C 1/03272 297/300.2 |
| 6,120,096 | A | 9/2000 | Miotto | |
| 2013/0221719 | A1* | 8/2013 | Costaglia | A47C 1/032 297/340 |
| 2015/0230608 | A1* | 8/2015 | Unwalla | A47C 1/03294 297/325 |
| 2018/0289159 | A1* | 10/2018 | Bock | A47C 1/03205 |
| 2021/0177144 | A1* | 6/2021 | Theesfeld | A47C 1/03277 |

FOREIGN PATENT DOCUMENTS

| | | | | |
|---|---|---|---|---|
| DE | 3737491 | A * | 5/1989 | A47C 1/03255 |
| DE | 19823632 | C1 * | 9/1999 | A47C 1/03272 |
| EP | 0198056 | A1 | 10/1986 | |
| EP | 1945063 | B1 * | 12/2015 | |
| ES | 2060487 | A2 | 11/1994 | |
| WO | WO 86/02536 | A1 | 5/1986 | |
| WO | WO-2007012418 | A1 * | 2/2007 | A47C 31/126 |
| WO | WO-2016074723 | A1 * | 5/2016 | A47C 1/03255 |

OTHER PUBLICATIONS

Italian Search Report dated Oct. 11, 2019 issued in IT 102019000002723, with partial translation.
English Abstract of WO8602536A1 dated May 9, 1986.

* cited by examiner

*Primary Examiner* — Robert Canfield
(74) *Attorney, Agent, or Firm* — Scully, Scott, Murphy & Presser, P.C.

(57) ABSTRACT

A chair provided with a plate, to which a seat is freely articulated above, by way of at least one first linkage and a second pair of linkages in the rear and front regions, a backrest being articulated laterally and freely to said seat. The first end of a pair of cams is pivoted to the plate at the rear, and the second end is pivoted to the backrest.

8 Claims, 11 Drawing Sheets

CHAIR ADAPTED TO FORCE A FORWARD AND DOWNWARD MOVEMENT OF THE SEAT WITH RESPECT TO A BACKWARD INCLINATION IMPARTED TO THE BACKREST

The present invention relates to a chair of the type provided with a rocking mechanism.

Nowadays it is known to provide chairs that are fitted with a mechanism the function thereof is to enable for example the height adjustment of a sitting portion and the adjustment of the rocking, or the locking in place, of a backrest.

An example of the known art mentioned is disclosed in U.S. Pat. No. 6,120,096, where the activation of the mechanisms which interact with the sitting portion and with the backrest are activated by way of using a first lever, the rotation of which leads to the packing or otherwise of special slats, and also a second lever, the lifting of which enables its terminal end to interact with a gas-filled piston present on a central gas-operated post.

Springs make it possible to contrast the oscillation of the backrest with respect to the sitting portion, according to a preset value which is linked to the specific elastic constant of said springs.

Means are present which are adapted to allow the packing of some slats, which makes it possible to limit the mutual positioning between the seat and the backrest, up to the point where it is locked.

Such adjustment of the position of the backrest is however rather imprecise and requires a given force by the user in order to pack the slats, and the extent of the packing is in any case difficult to repeat over time.

As a partial solution to such drawbacks, it is also known to produce chairs in which, in particular, applying a force on the backrest simultaneously results in an action on the seat.

Such a solution is for example known from EP1945063 in which there is a seating apparatus that comprises a base, a curved support bar with an upper backrest support portion, and a lower seat support portion, which are fixed to each other by way of a curved portion, one or more ramps and one or more components for facilitating motion for interaction with one or more of the ramps.

In such solution, the curved support bar is formed and contoured to be a single component, and the curved portion of the curved support bar advantageously acts as a spring element, allowing a certain degree of bending of the curved support bar.

Furthermore the curved support bar comprises a plurality of ramps which are fixed to it directly or indirectly; for example, the ramps can be fixed directly on a surface of the seat supporting portion of the curved support bar or, alternatively, the ramps can be fixed to a cross support which is in turn integrally fixed to the seat supporting portion.

The components for facilitating motion are constituted for example by rollers and the ramps interact with the rollers in order to allow motion forward and backward, in addition to a lifting movement, for the seat portion of the seating apparatus.

Such solution also presents drawbacks in that a relative motion is encountered between the seat and the backrest that leads the seat to rise excessively from the ground: this results in an uncomfortable situation for the user given that it lifts the knees and as a consequence it is possible that the feet leave the ground, which facilitates the onset of tingling and other forms of physical discomfort.

Furthermore the structural composition of the various components appears complex and, given the rolling of the rollers on the ramps, there is friction and possible sticking during the movement of the seat and the backrest.

Also known is US2013221719A1 in which a tilt mechanism for a chair is illustrated, in which the seat of the chair is forced to move upward when it is simultaneously moved forward following the inclination of the backrest.

This solution therefore also presents the drawback of creating discomfort for the user given that the knees are lifted up and as a consequence it is possible that the feet may leave the ground.

In fact, in this solution, an estimated lifting of about 20 mm occurs of the seat portion during the tilting of the backrest.

As a consequence the user is forced at least to lift his or her heels in order to compensate for the lifting of the edge of the seat during the tilting of the backrest.

Such lifting of the front edge of the seat produces, as a consequence, an increase in the pressure in the lower region of the legs, with possible consequent reduction of the blood flow, which facilitates the onset of tingling and other forms of physical discomfort.

In this solution, furthermore, there are, in an additional embodiment, slots and channels, provided on the wings of the guide track and on the slots, which together go to make up the mechanism.

Such structural solution presents a high friction during movement, owing to the sliding of the corresponding pins which, owing to the curved shape of the corresponding seats, slip and result in an operation that chafes and is not smooth.

Accordingly, the user will have a sensation of a nonlinear operation of the mechanism that has a more "sluggish" movement.

Furthermore, such friction can cause greater wear of the parts, which requires more burdensome maintenance or the use of more expensive materials and production techniques.

The aim of the present application is therefore to solve the above mentioned technical problems, eliminating the drawbacks in the cited known art and hence providing a chair provided with a rocking mechanism that makes it possible to achieve, rapidly, simply and repeatably, a simultaneous adjustment of the position both of the backrest and of the seat while maintaining a condition of comfort for the user.

Within this aim, an object of the invention is to provide a chair that makes it possible to achieve a relative motion between the seat and the backrest which is such as to prevent the seat from tending to lift.

Another object is to obtain, as a consequence of tilting the backrest, a chair wherein an arrangement for the seat that favors resting the feet of the user on the ground, thus increasing the sensation of comfort for the user.

Another object is to provide a chair that offers an operation that is linear and smooth.

Another object is to provide a chair that is structurally simple, requires low maintenance, is of low cost and can be made with the usual conventional systems.

This aim and these and other objects which will become better apparent hereinafter are achieved by a chair, characterized in that it is provided with a plate, to which a seat is freely articulated above, by way of at least one first linkage and a second pair of linkages in rear and front regions, a backrest being articulated laterally and freely to said seat, a first end of a pair of cams being pivoted to said plate at the rear, a second end being pivoted to said backrest, said pair of cams having arc-like guiding means for a sliding of at least one pivot which is integral with and protrudes from said backrest, said at least one first linkage and said second pair of linkages and said pair of cams being adapted to force a forward and downward movement of said seat with respect to a backward inclination that can be imparted to said backrest.

Further characteristics and advantages of the invention will become better apparent from the detailed description of a particular, but not exclusive, embodiment which is illustrated by way of non-limiting example in the accompanying drawings wherein.

Figure 1:
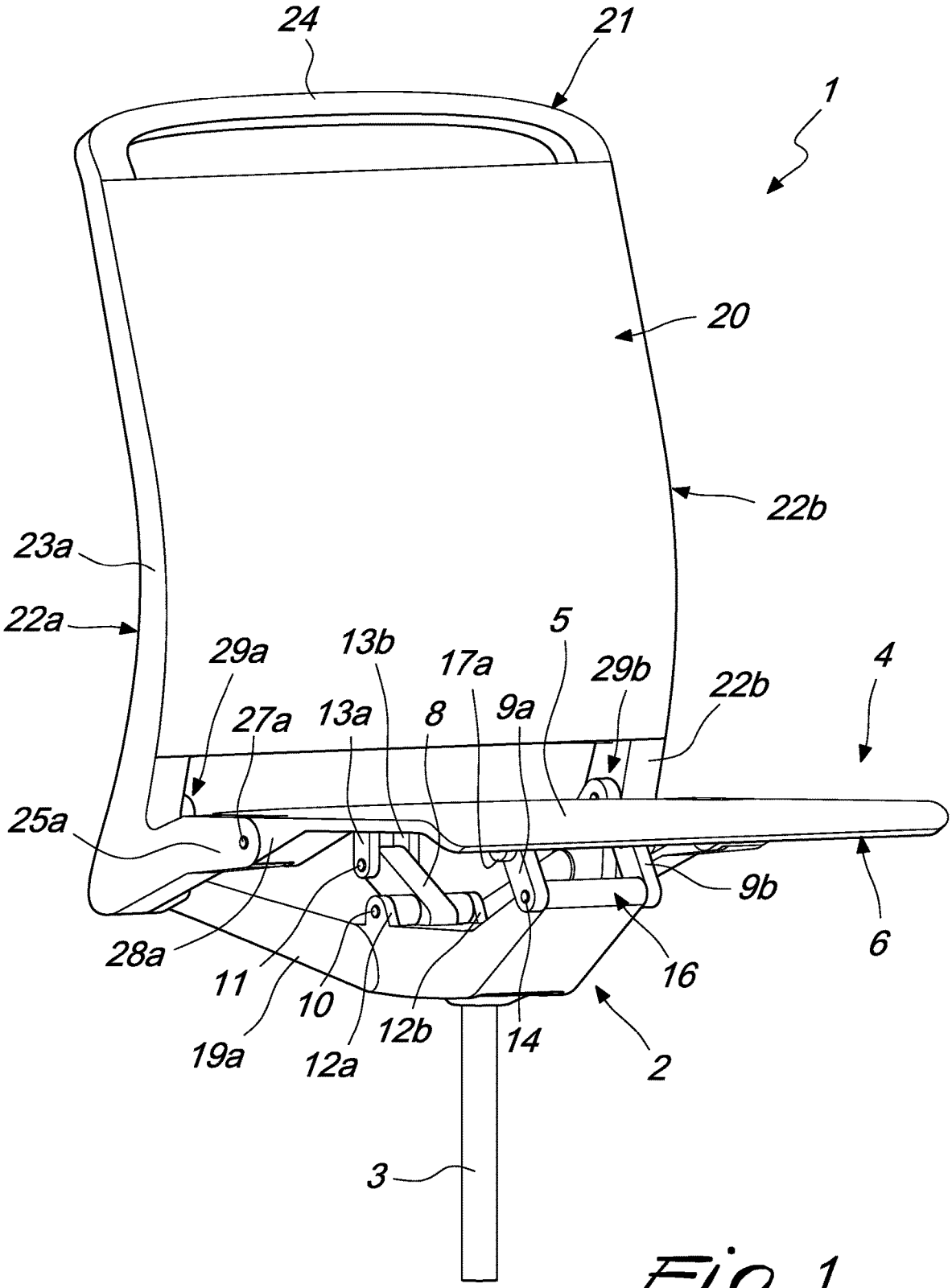
FIG. 1 is a first perspective front elevation view of the chair in the condition in which the backrest is not activated.
Figure 2:
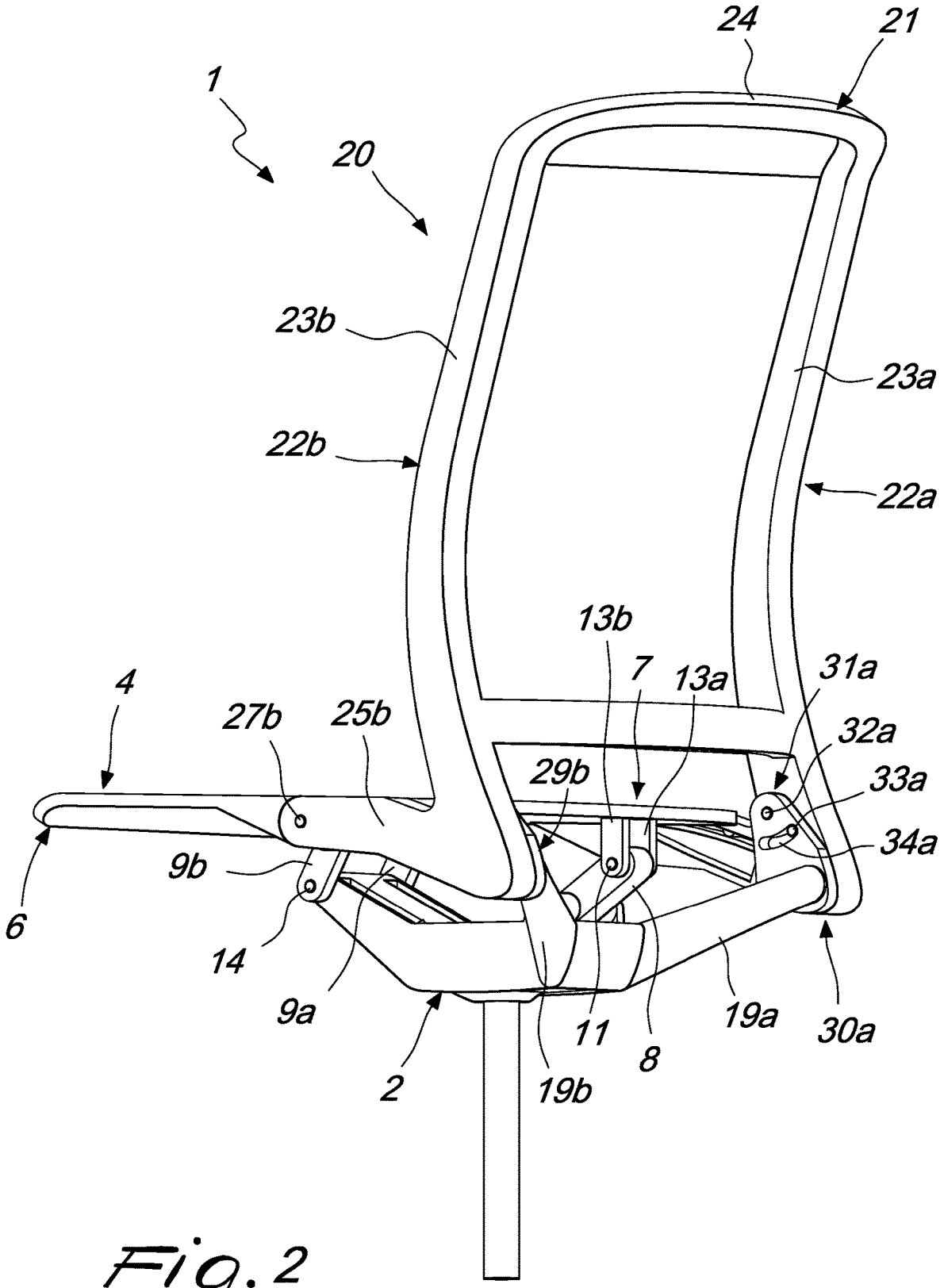
FIG. 2 is a second perspective rear elevation view of the chair in the condition in which the backrest is not activated.
Figure 3:
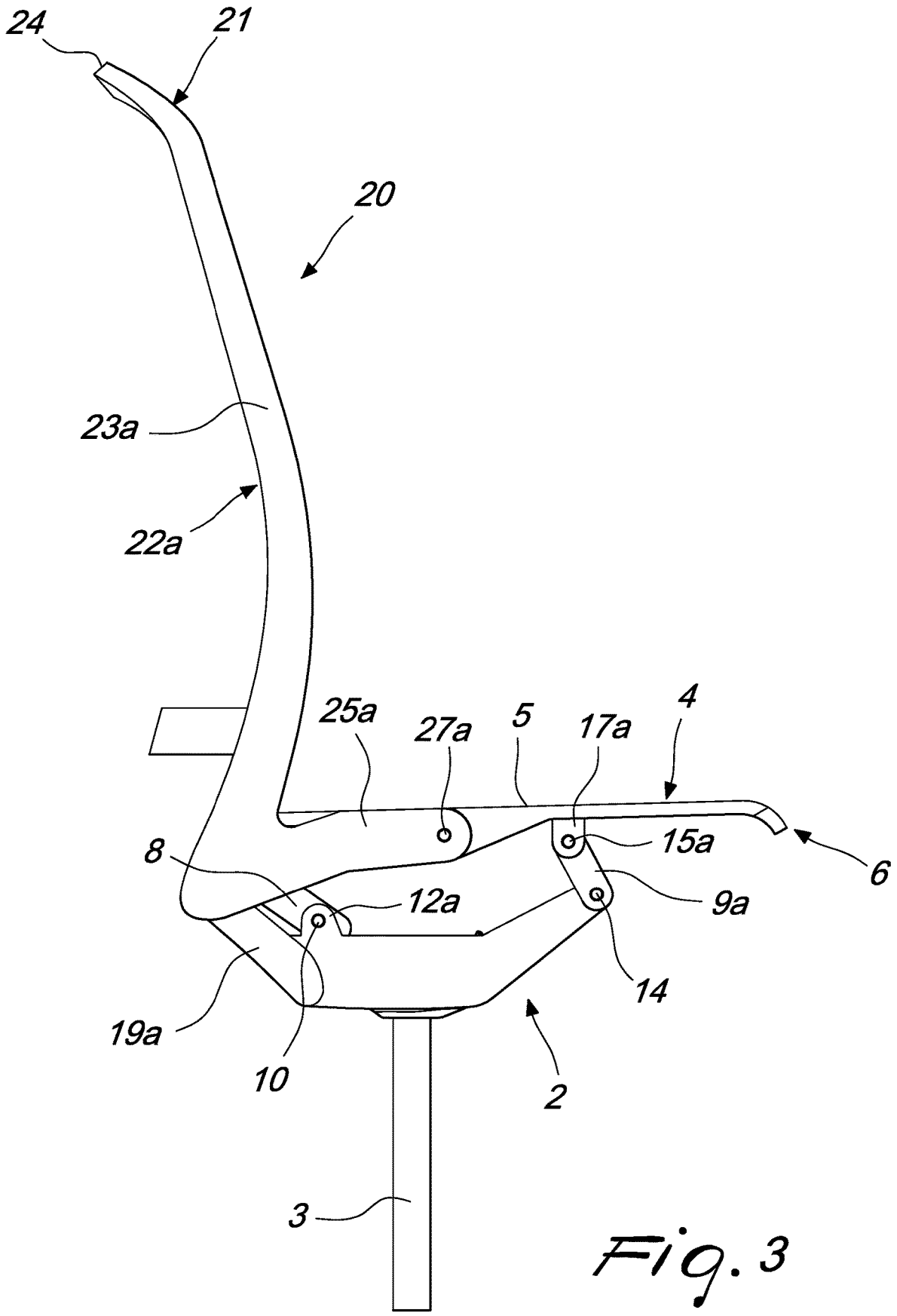
FIG. 3 is a side view of the chair.

In the embodiments illustrated below, individual characteristics shown in relation to specific examples may in reality be interchanged with other, different characteristics, existing in other embodiments.

Moreover, it should be noted that anything found to be already known during the patenting process is understood not to be claimed and to be the subject of a disclaimer.

With reference to the figures, the reference numeral 1 generally designates a chair with a box-shaped plate 2, which is associated with a gas-operated central column 3 that protrudes below and which cooperates with conventional means adapted to allow the lifting and lowering of the chair.

The plate 2 is associated with a seat 4 above, which has a sitting portion 5 which has a substantially rectangular shape, with the front region 6 slightly arc-shaped toward the ground and the rear region 7 substantially flat.

The sitting portion 5 of the seat 4 is freely articulated below, proximate to the rear region 7 and the front region 6, to the underlying plate 2 by way of, respectively, a first linkage 8 and a second pair of linkages 9*a*, 9*b*.

The first linkage 8 is arranged substantially along the longitudinal central axis of the sitting portion 5 and is pivoted transversely freely at its ends, by way of a first pivot 10 and a second pivot 11, respectively between a pair of shoulders 12*a*, 12*b* which protrude to the rear from the plate 2 toward the seat 4, and between a pair of first protrusions 13*a*, 13*b* which protrude below the sitting portion 5 of the seat 4.

Each one of the second pair of linkages 9*a*, 9*b* is pivoted transversely freely at its ends, by way of a third pivot 14 and a fourth pivot 15*a*, 15*b*, respectively to the terminal and front end 16 of said plate 2 that is directed toward the front region 6 and between a pair of second protrusions 17*a*, 17*b* which protrude below the sitting portion 5 of the seat 4.

A pair of rods 19*a*, 19*b* protrude laterally and slightly upward at the rear end 18 of the plate 2, a backrest 20 being freely articulated to the free ends of said rods.

In particular the backrest 20 is provided with a frame 21 which is composed of two L-shaped arms 22*a* and 22*b* so as to define a first wing 23*a* and a second wing 23*b*, which are vertical and are blended above by a crossmember 24, and a third wing 25*a* and a fourth wing 25*b*, which are substantially horizontal.

A fifth pivot 26*a*, 26*b* for pivoting to the free ends of the pair of rods 19*a*, 19*b* is arranged transversely at the blending region between the first, second, third and fourth wings 23*a*, 23*b*, 25*a*, 25*b*.

A sixth pivot 27*a*, 27*b* is arranged transversely proximate to the terminal ends of the third wing 25*a* and the fourth wing 25*b*, for pivoting to a pair of third protrusions 28*a*, 28*b* which are integral with and protrude laterally and below from the seat 4.

The connection between the backrest 20 and the pair of rods 19*a*, 19*b* occurs by way of a pair of cams 29*a*, 29*b* with a substantially rhomboid shape structure which are pivoted at a first end 30*a*, 30*b*, by way of the fifth pivot 26*a*, 26*b*, to the free ends of the pair of rods 19*a*, 19*b* and are pivoted at a second end 31*a*, 31*b*, which is opposite to the previous first end 30*a*, 30*b*, by way of a sixth pivot 32*a*, 32*b*.

The pair of cams 29*a*, 29*b* has arc-like guiding means for the sliding of at least one seventh pivot 33*a*, 33*b* which is integral with and protrudes from the first wing 23*a* and the second wing 23*b* in a region that is adjacent to the region for blending with the third wing 25*a* and the fourth wing 25*b*.

Each seventh pivot 33*a*, 33*b* acts in an arc-like through seat 34*a*, 34*b* provided in the pair of cams 29*a*, 29*b* in an intermediate region between the fifth pivot 26*a*, 26*b* and the sixth pivot 32*a*, 32*b*.

The shape structure of the seat 34*a*, 34*b* is such as to have a curvature with the center directed toward the sixth pivot 32*a*, 32*b*.

Figure 4:
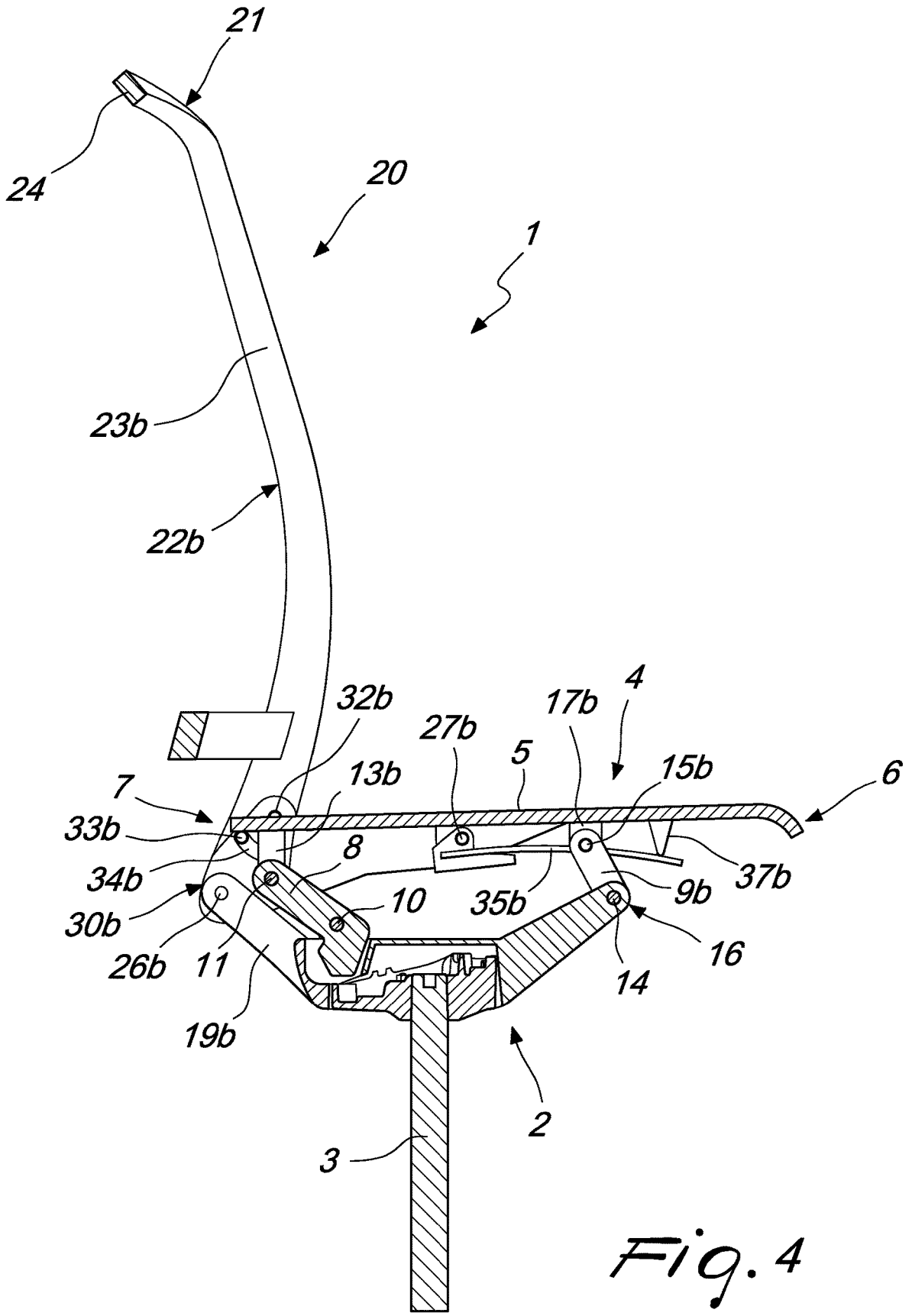
FIG. 4 is a cross-sectional view of the chair taken along a central axis of the seat.
Figure 5:
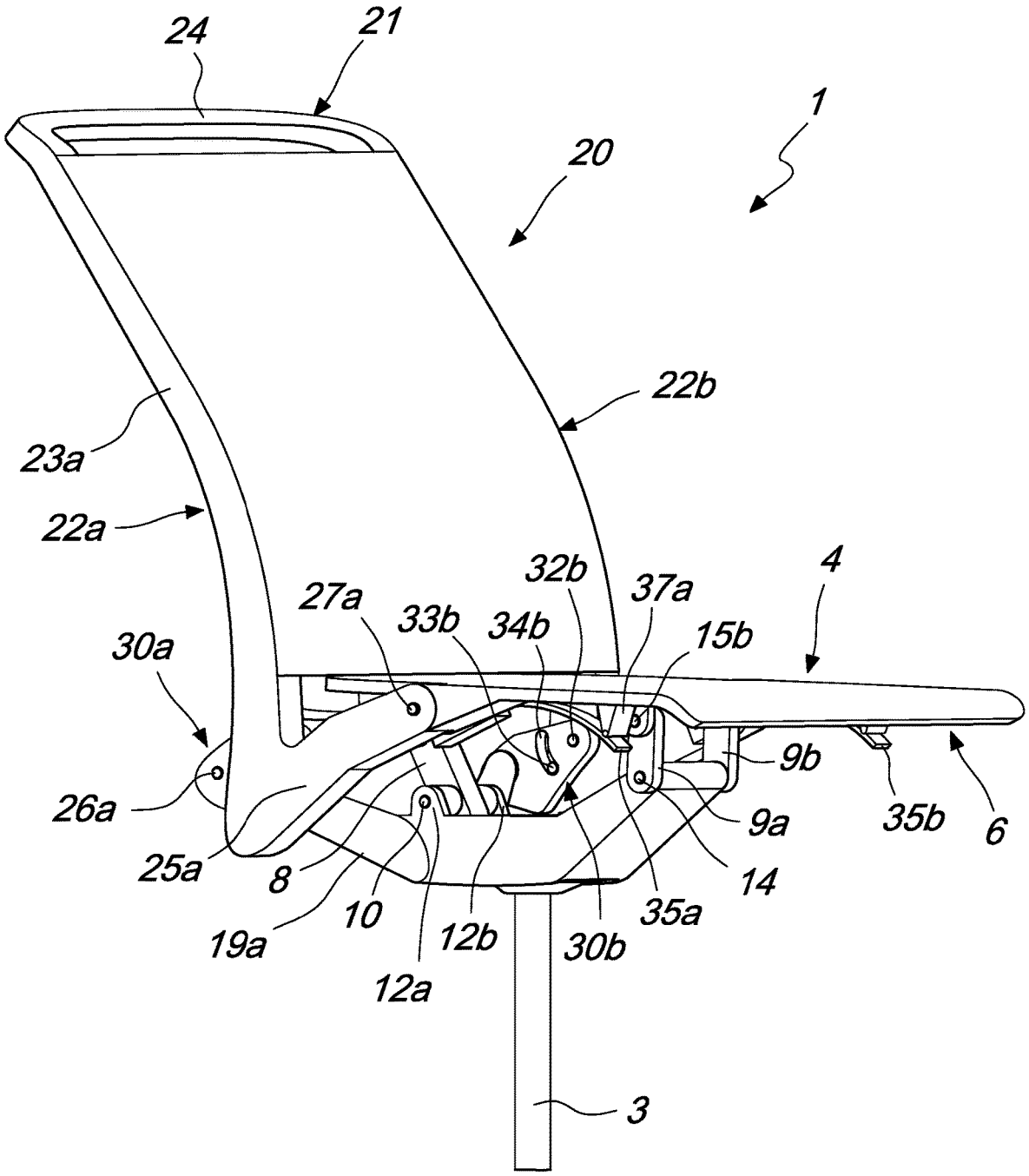
FIG. 5 is a third perspective front elevation view of the chair in the condition in which the backrest is activated.
Figure 6:
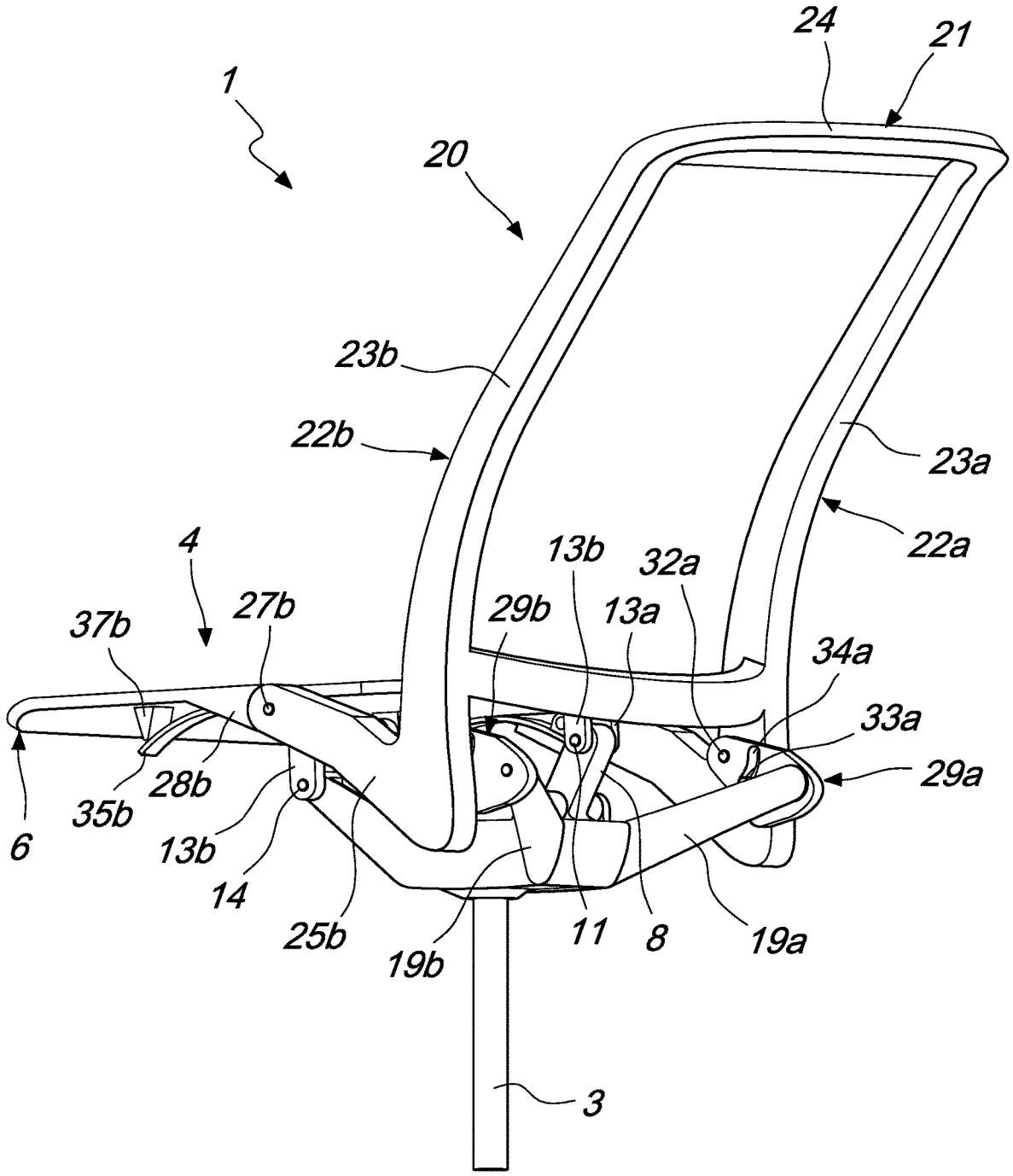
FIG. 6 is a fourth perspective rear elevation view of the chair in the condition in which the backrest is activated.
Figure 7:
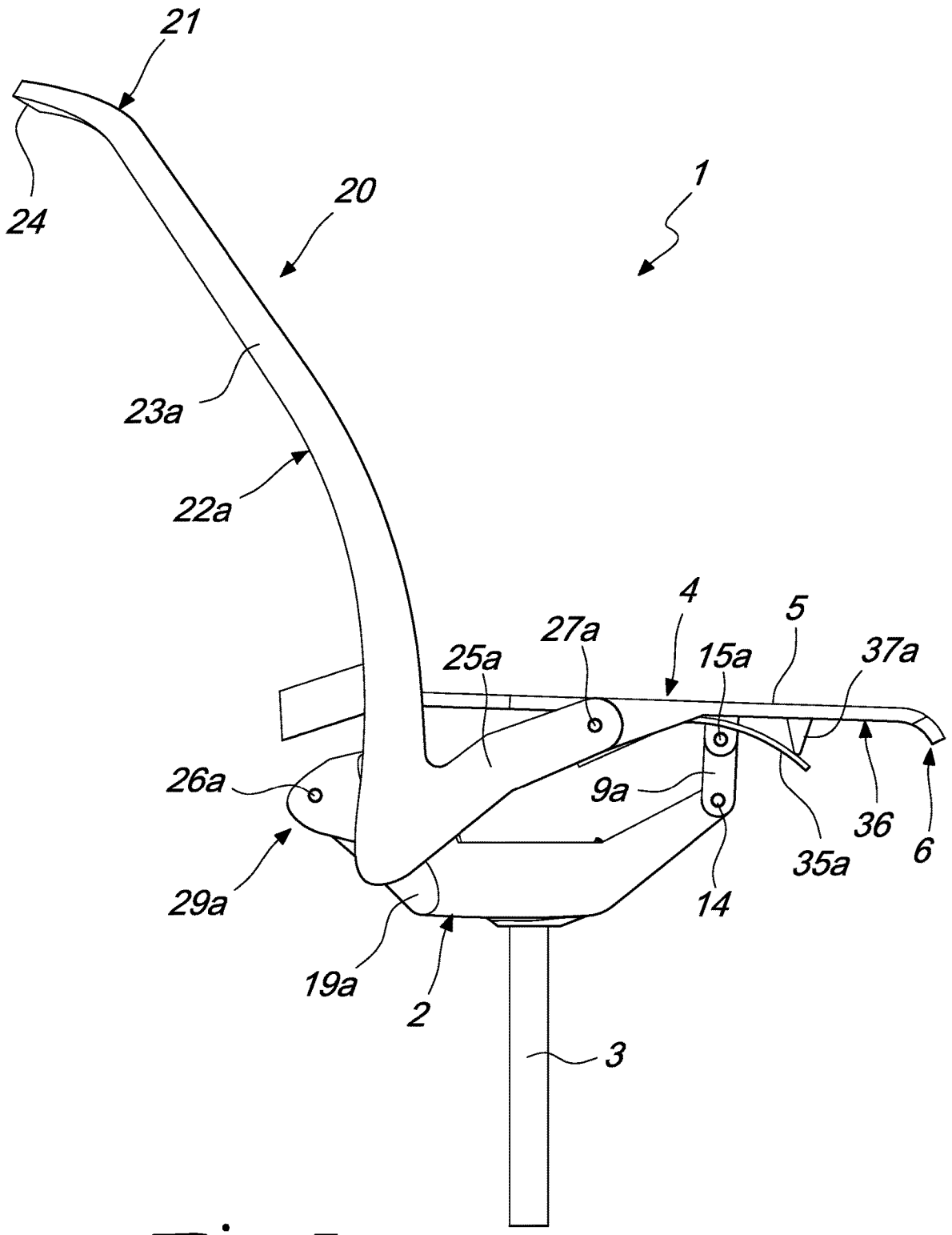
FIG. 7 is a side view of the chair in FIG. 5.
Figure 8:
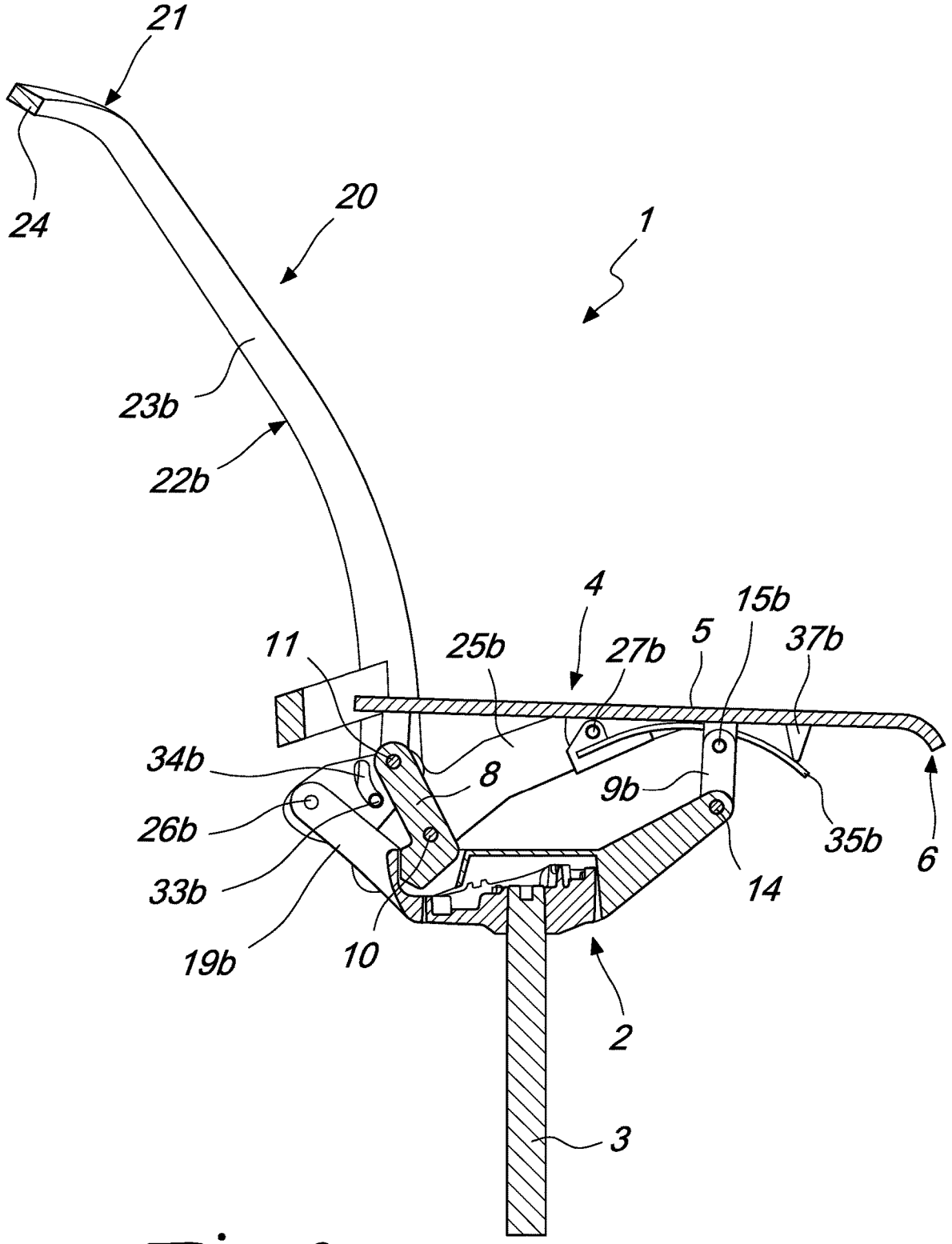
FIG. 8 is a cross-sectional view of the chair in the previous figure, taken along a central axis of the seat.
Figure 9:
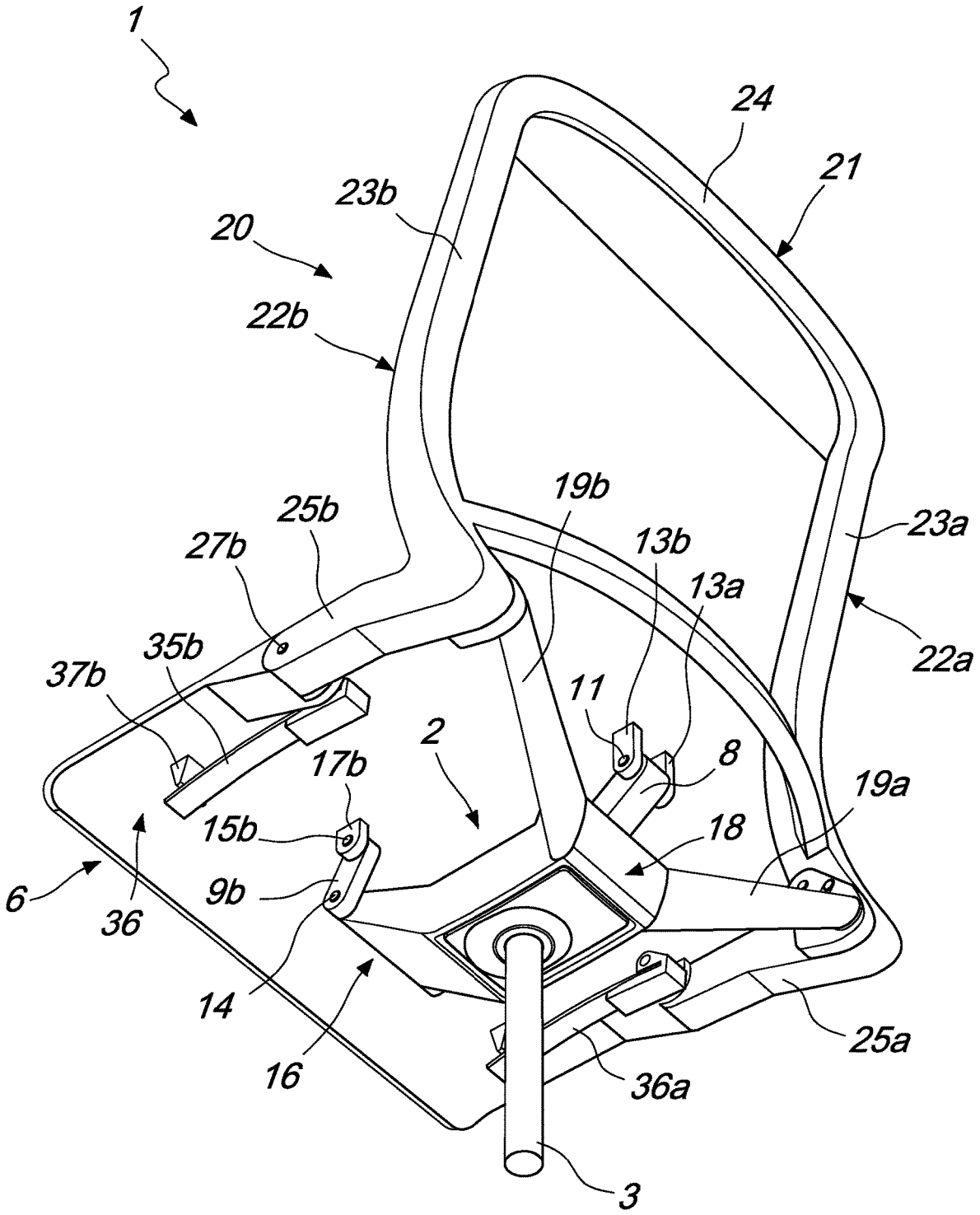
FIG. 9 is a fifth perspective view from below of the chair in the condition in which the backrest is not activated.
Figure 10:
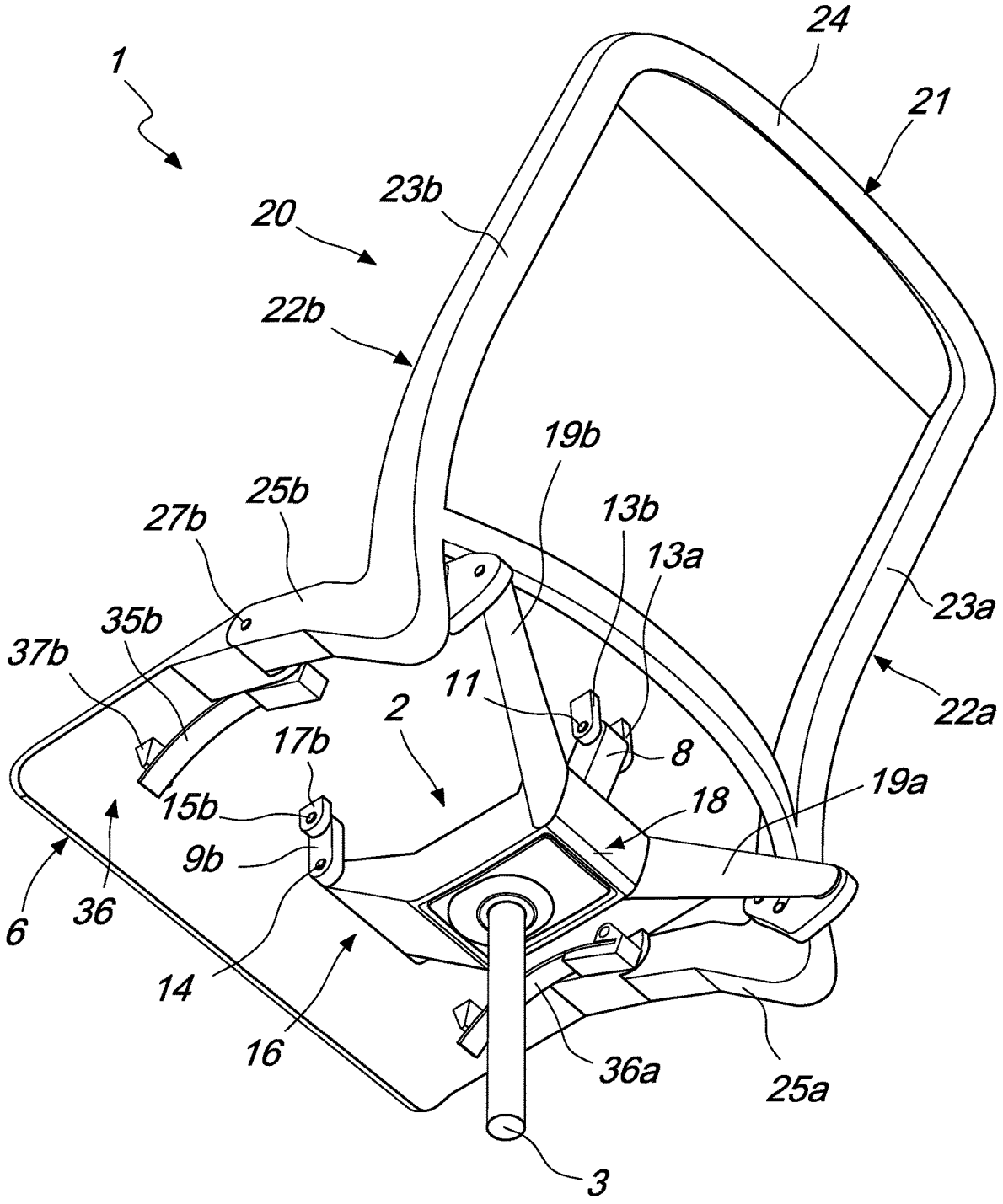
FIG. 10 is a sixth perspective view from below of the chair in the condition in which the backrest is activated.
Figure 11:
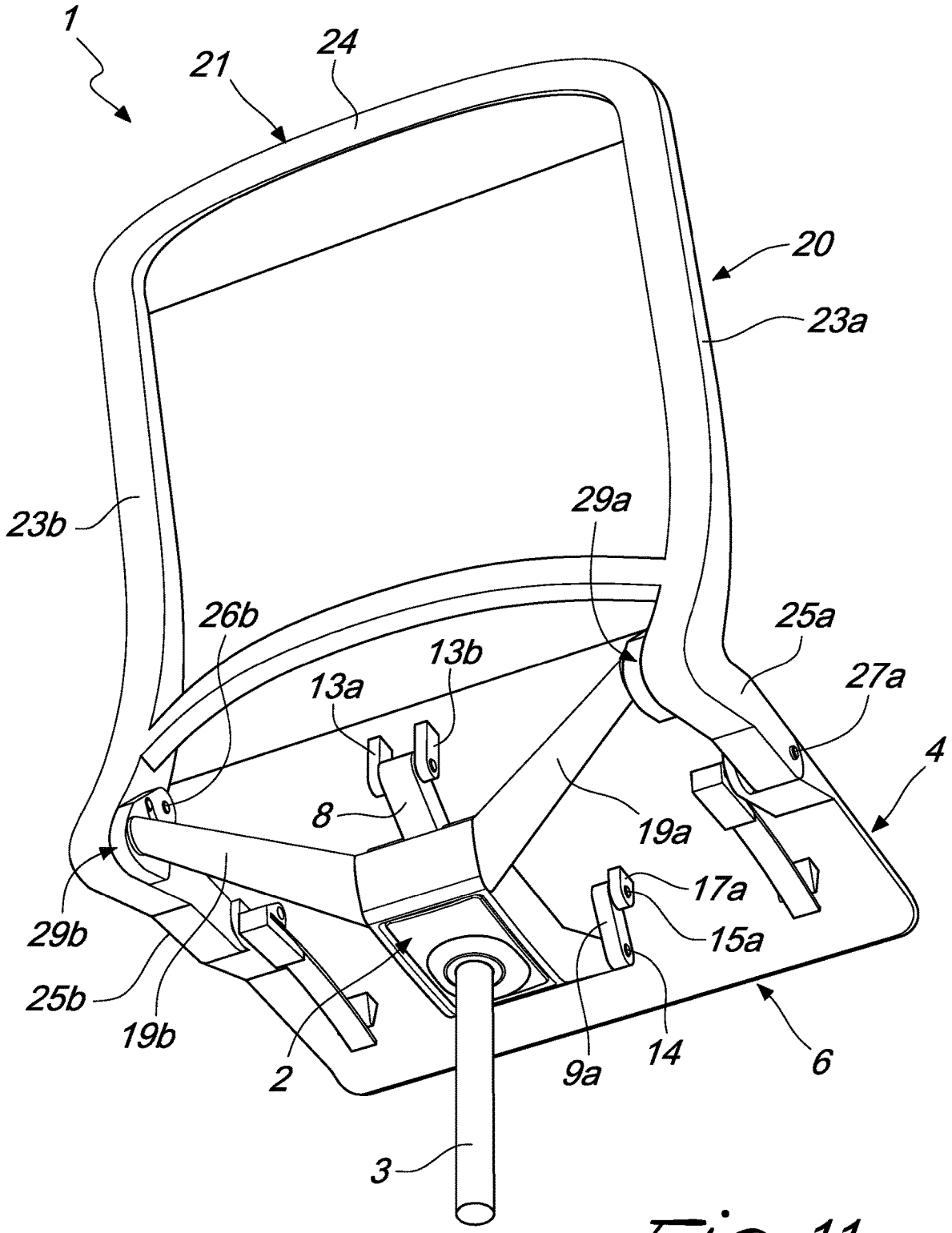
FIG. 11 is a seventh perspective view from below of the chair in the condition in which the backrest is not activated.

The arrangement of the various articulations among the various components of the chair is such that, with respect to a horizontal plane and in the inactive condition with the flat seat shown in FIG. 4, there is the following sequence, from the bottom upward, of the planes of arrangement of the various pivots: the first pivot 10, the third pivot 14, the second pivot 11, the fifth pivot 26*a*, 26*b*, the fourth pivot 15*a*, 15*b* and the sixth pivot 32*a*, 32*b*.

This arrangement, together with the arrangement assumed by the first linkage 8 and the second pair of linkages 9*a*, 9*b* and the pair of cams 29*a*, 29*b*, is adapted to force the forward and downward movement of the seat 4 with respect to a backward inclination that can be imparted to the backrest 20, as shown in the transition from FIGS. 4 to 7.

The chair 1 is further provided with a pair of leaf springs 35*a*, 35*b* which are interposed between the lower surface 36 of the seat 4 and the lateral and free point of articulation of the seat 4 to the backrest 20; in particular each one of the pair of leaf springs 35*a*, 35*b* is, at its ends, on one side laterally integral with the pair of third protrusions 28*a*, 28*b* and on the other side able to freely slide on abutments 37*a*, 37*b*, advantageously substantially triangular in shape, that protrude from the lower surface 36 of the seat 4 proximate to the front region 6 of the seat 4 and with the vertex directed downward.

The pair of leaf springs 35*a*, 35*b* is loaded as a consequence of the force imparted by the user to impose a backward inclination of the backrest, and they facilitate the subsequent repositioning thereof to the initial condition upon the cessation of such force.

Thus it has been found that the invention fully achieves the intended aim and objects, an invention having been obtained that makes it possible to achieve, by applying a force on the backrest that makes it recline backwards, a simultaneous change in the position of the seat so that it lowers its front end toward the ground until its stroke limit, thus making it possible to achieve, rapidly, simply and repeatably, an adjustment that improves the comfort for the user.

In fact the feet of the user remain constantly placed properly on the floor.

Finally, the chair according to the invention is structurally simple, offers an operation that is linear and smooth, and requires low maintenance.

Naturally the materials used as well as the dimensions of the individual components of the invention may be more relevant according to specific requirements.

The characteristics indicated above as advantageous, convenient or the like, may also be missing or be substituted by equivalent characteristics.

The disclosures in Italian Patent Application No. 102019000002723 from which this application claims priority are incorporated herein by reference.

What is claimed is:

1. A chair, provided with a plate, to which a seat is freely articulated above, by way of at least one first linkage and a second pair of linkages in rear and front regions, a backrest being articulated laterally and freely to said seat, a first end of a pair of cams being pivoted to said plate at the rear, a second end being pivoted to said backrest, said pair of cams having arc-like guiding means for a sliding of at least one pivot which is integral with and protrudes from said backrest, said at least one first linkage and said second pair of linkages and said pair of cams being adapted to force a forward and downward movement of said seat with respect to a backward inclination that can be imparted to said backrest.

2. The chair according to claim 1, wherein said seat has a sitting portion which has a substantially rectangular shape, with a front region slightly arc-shaped toward the ground and the rear region substantially flat, said sitting portion being freely articulated below, proximate to said rear region and said front region, to said underlying plate respectively by way of said first linkage and said second pair of linkages, said first linkage being arranged substantially along the longitudinal central axis of said sitting portion and being pivoted transversely freely at its ends, by way of a first pivot and a second pivot, respectively between a pair of shoulders which protrude to the rear from said plate toward said seat, and between a pair of first protrusions which protrude below said sitting portion of said seat.

3. The chair according to claim 2, wherein each one of said second pair of linkages is pivoted transversely freely at its ends, by way of a third pivot and a fourth pivot, respectively to the terminal and front end of said plate that is directed toward said front region and between a pair of second protrusions which protrude below said sitting portion of said seat.

4. The chair according to claim 2, wherein a pair of rods protrude laterally and slightly upward at a rear end of said plate, a backrest being freely articulated to free ends of said rods and being provided with a frame which is composed of two L-shaped arms so as to define a first wing and a second wing, which are vertical and are blended above by a cross-member, and a third wing and a fourth wing, which are substantially horizontal, a fifth pivot for pivoting to said free ends of said pair of rods being arranged transversely at the blending region between said first, second, third and fourth wings.

5. The chair according to claim 4, wherein a sixth pivot is arranged transversely proximate to terminal ends of said third wing and said fourth wing, for pivoting to a pair of third protrusions which are integral with and protrude laterally and below from said seat.

6. The chair according to claim 4, wherein a connection between said backrest and said pair of rods occurs by way of a pair of cams with a substantially rhomboid shape structure which are pivoted at a first end, by way of said fifth pivot, to said free ends of said pair of rods and are pivoted at a second end, which is opposite to said first end, by way of a sixth pivot, said pair of cams having arc-like guiding means for the sliding of at least one seventh pivot which is integral with and protrudes from said first wing and said second wing in a region that is adjacent to the region for blending with said third wing and said fourth wing, each said pivot, which is integral with and protrudes from said backrest, acting in an arc-like through seat provided in said pair of cams in an intermediate region between said fifth pivot and said sixth pivot, the shape structure of said seat being such as to have a curvature with a center directed toward said sixth pivot.

7. The chair according to claim 6, wherein an arrangement of the various articulations among the various components of said chair is such that, with respect to a horizontal plane and in the condition in which said seat is in a horizontal position, there is a sequence, from the bottom upward, of planes of arrangement that pass between said first pivot, said third pivot, said second pivot, said fifth pivot, said fourth pivot and said sixth pivot, said arrangement, together with the arrangement assumed by said first linkage and said second pair of linkages and said pair of cams, being adapted to force the forward and downward movement of said seat with respect to a backward inclination that can be imparted to said backrest.

8. The chair according to claim 5, wherein it is provided with a pair of leaf springs which are interposed between a lower surface of said seat and a lateral and free point of articulation of said seat to said backrest, each one of said pair of springs being, at its ends, on one side laterally integral with said pair of third protrusions and on the other side able to freely slide on abutments that protrude from said lower surface of said seat proximate to said front region of said seat and with the vertex directed downward.

* * * * *